United States Patent [19]

de Backer

[11] 4,315,716

[45] Feb. 16, 1982

[54] SUCTION CONTROL VALVE

[75] Inventor: Pieter A. de Backer, Grouw, Netherlands

[73] Assignee: de Backer's Compressoren B.V., Netherlands

[21] Appl. No.: 100,546

[22] Filed: Dec. 5, 1979

[51] Int. Cl.[3] ..... F04B 49/08

[52] U.S. Cl. ..... 417/27; 417/28; 417/295; 417/317

[58] Field of Search ..... 417/26, 27, 28, 317, 417/295, 298

[56] References Cited

U.S. PATENT DOCUMENTS

| | | | |
|---|---|---|---|
| 2,317,119 | 4/1943 | Stevens | 417/26 |
| 3,023,765 | 3/1962 | Gresko | 417/298 X |
| 3,602,610 | 8/1971 | Bloom | 417/295 X |
| 3,860,363 | 1/1975 | Silvern et al. | 417/26 X |

*Primary Examiner*—Carlton R. Croyle
*Assistant Examiner*—Edward Look
*Attorney, Agent, or Firm*—Kane, Dalsimer, Kane, Sullivan and Kurucz

[57] ABSTRACT

A suction control valve adapted to be connected to the suction side of a compressor and comprising a valve housing, in which a valve seat is formed, which cooperates with a valve body which, in its opened position, brings the suction side of the compressor into open communication with the atmosphere. Said valve body is attached to a valve stem which, in its longitudinal direction, is slidably guided in the valve housing for the displacement of the valve body from the closed position to the open position and vice versa. A continuous bore in the valve stem is at one end in open communication with the suction side of the compressor, and opens at the other end into a diaphragm chamber, which is located on the side of a diaphragm facing away from the valve body, which diaphragm is fixed to the valve stem, while the diaphragm chamber is connected to a conduit, which accommodates a stop valve.

7 Claims, 3 Drawing Figures

SUCTION CONTROL VALVE

BACKGROUND OF THE INVENTION

The invention relates to a suction control valve adapted to be connected to the suction side of a compressor and comprising a valve housing, in which a valve seat is formed, which co-operates with a valve body which, in its opened position, brings the suction side of the compressor into open communication with the atmosphere.

The purpose of such suction control valves is to prevent the compressor from building up a back pressure during its starting period.

According to a known embodiment of such a suction control valve, the valve body is controlled by means of an adjusting cylinder which, when subjected to an overpressure, is capable of displacing the valve body to the open position, causing the suction side of the compressor to be brought into open communication with the atmosphere.

This known suction control valve has the disadvantage that the valve body has to leak slightly in the closed position, in order to create the possibility of an overpressure to be supplied to the adjusting cylinder. This leakage of the valve body, however, will unavoidably result in the set-up of some back pressure during the starting period of the compressor.

SUMMARY OF THE INVENTION

It is an object of the present invention to provide a suction control valve in which this disadvantage is effectively removed.

To this end, the valve body is attached to a valve stem which, in its longitudinal direction, is slidably guided in the valve housing for the displacement of the valve body from the closed position to the open position, and vice versa, while a continuous bore in the valve stem is at one end in open communication with the suction side of the compressor, and opens at the other end into a diaphragm chamber, which is located on the side of a diaphragm facing away from the valve body, which diaphragm is fixed to the valve stem, while the diaphragm chamber is connected to a conduit, which accommodates a stop valve.

Since, according to the invention, no use is made of a pneumatic adjusting cylinder, the valve body, when in its closed position, can completely seal with respect to its seat. As a result, the start-up of the compressor can be realized virtually without any back pressure.

The stop valve is preferably operated electromagnetically and may be controlled by the starting switch of the compressor motor in such a way that, when this starting switch changes over from star connection to delta connection, the stop valve is brought from the open position into the closed position.

In order to allow the compressor to continue running at no load after the final pressure to be supplied has been reached, said stop valve may be connected by an additional conduit to a rapid blow-off valve for a pressure vessel connected to the delivery side of the compressor.

This rapid blow-off valve may consist of a cylinder, which slidingly accommodates a piston, which is fastened upon a hollow piston rod, which bears outside the cylinder a hollow valve body, the bore of which connects to that of the piston rod, said valve body co-operating with a valve seat in the pressure vessel, while the further conduit opens into the cylinder on the side of the piston which faces away from the valve body.

Further the stop valve may be operated by means of a pressure switch, which opens the valve when the desired final pressure in the pressure vessel has been reached.

BRIEF DESCRIPTION OF THE DRAWINGS

The invention will be explained hereinafter with reference to the drawings, which illustrate an embodiment of a suction control valve according to the invention together with its accessory equipment by way of example.

DESCRIPTION OF A PREFERRED EMBODIMENT

Figure 2:
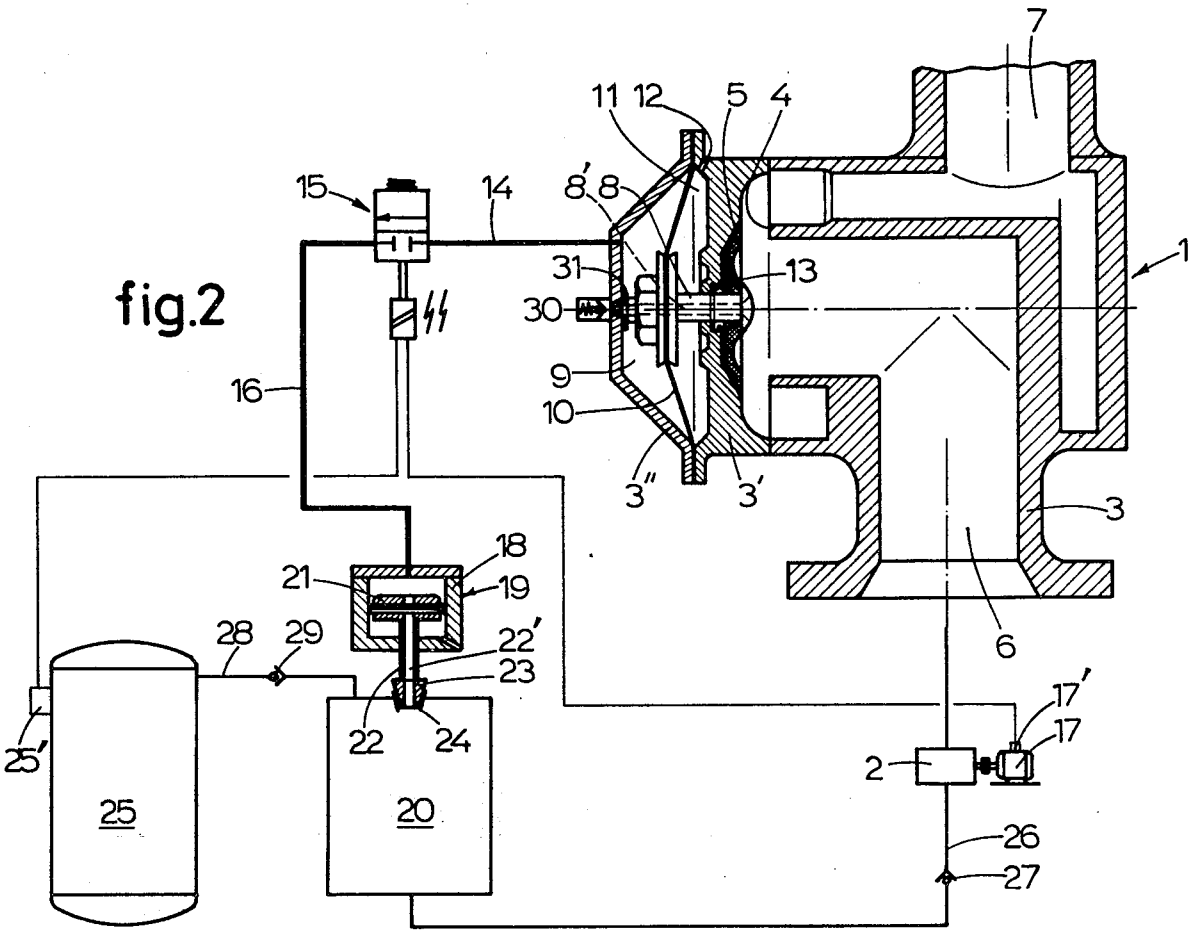
FIG. 2 is a sectional view corresponding with that of FIG. 1, but in which the suction control valve with accessory equipment is in the position assumed during the compressing action of the compressor.

The drawing shows a suction control valve 1, which is connected to the suction side of a compressor 2. The suction control valve 1 comprises a valve housing 3, in which a valve seat 4 is formed, which co-operates with a valve body 5. In the closed position of the valve body 5, the space 6 in the valve housing, which connects to the suction side of the compressor 2, is sealed off by means of the valve body 5 from the space 7 of the valve housing, which is in open communication with the atmosphere. The spaces 6 and 7 of the valve housing are in open communication with each other when the valve body 5 assumes its open position (FIG. 2).

The valve body 5 is fixed on a hollow valve stem 8, which is slidably guided in its longitudinal direction inside the valve housing 3 for the displacement of the valve body 5 from the closed position to the open position, and vice versa. The continuous bore 8' in the valve stem 8 is connected at its one end, downstream from the valve body 5 to the space 6 of the valve housing, the other end of this bore 8' opening into a diaphragm chamber 9, which is located on the side of a diaphragm 10 facing away from the valve body 5. This diaphragm 10 is retained at its outer edge between the parts 3' and 3'' of the valve housing and is furthermore fixed to the valve stem 8. The chamber 11 on the other side of the diaphragm 10 is permanently in open communication with the atmosphere through an opening 12. The valve body 5 is loaded in the direction of its closed position by a spring 13, so that the valve body 5 assumes the closed position when the suction control valve 1 is in the position of rest. The diaphragm chamber 9 is connected by a conduit 14 to an electromagnetically operated stop valve 15, which in its one position connects the conduit 14 to a further conduit 16, but which in its other position interrupts the connection between the conduits 14 and 16. This valve 15 is preferably moved from the open position to the closed position by means of the star-delta switch 17' of the compressor motor 17. The further conduit 16 opens into a cylinder 18 of a rapid blow-off valve 19 for an auxiliary pressure vessel 20, which is connected to the delivery side of the compressor 2. The rapid blow-off valve 19 comprises a piston 21 in the cylinder 18, which piston 21 is fastened upon a hollow piston rod 22 which, outside the cylinder 18, bears a hollow valve body 23, which co-operates with a valve seat 24 in the auxiliary pressure vessel 20. The bore 22' in the piston rod 22 connects to the bore in the valve body 23 and has a relatively small diameter.

In the embodiment shown, the main pressure vessel 25 is connected to the auxiliary pressure vessel 20, so that the main pressure vessel 25 receives its air by way of the auxiliary pressure vessel 20, but this is not absolutely necessary. The conduit 26 between the delivery side of the compressor 2 and the auxiliary pressure vessel 20 comprises a non return back pressure valve 27, while a non return back pressure valve 29 is likewise mounted in the conduit 28 between the auxiliary pressure vessel 20 and the main pressure vessel 25.

The operation of the suction control valve 1 with its accessory equipment is as follows During the starting period of the compressor 2, the valve body 5 is in the closed position, so that the vacuum generated on the suction side of the compressor 2 prevails in the space 6 of the valve housing and retains the valve body 5 in the closed position. Although the vacuum extends through the bore 8' in the valve stem 8 into the diaphragm chamber 9, this chamber 9 receives air through the conduit 14, the electromagnetically operated valve 15 which is in its open position, the further conduit 16, the cylinder 18 of the rapid blow-off valve 19, the bore 22' in the piston rod 22 and the bore in the valve body 23. The valve body 23 can be in the closed position (for example, under the action of a pressure spring in the cylinder 18), wherein it rests upon the valve seat 24 in the pressure vessel 20, but this is not absolutely necessary for the operation of the suction control valve 1.

Figure 1:
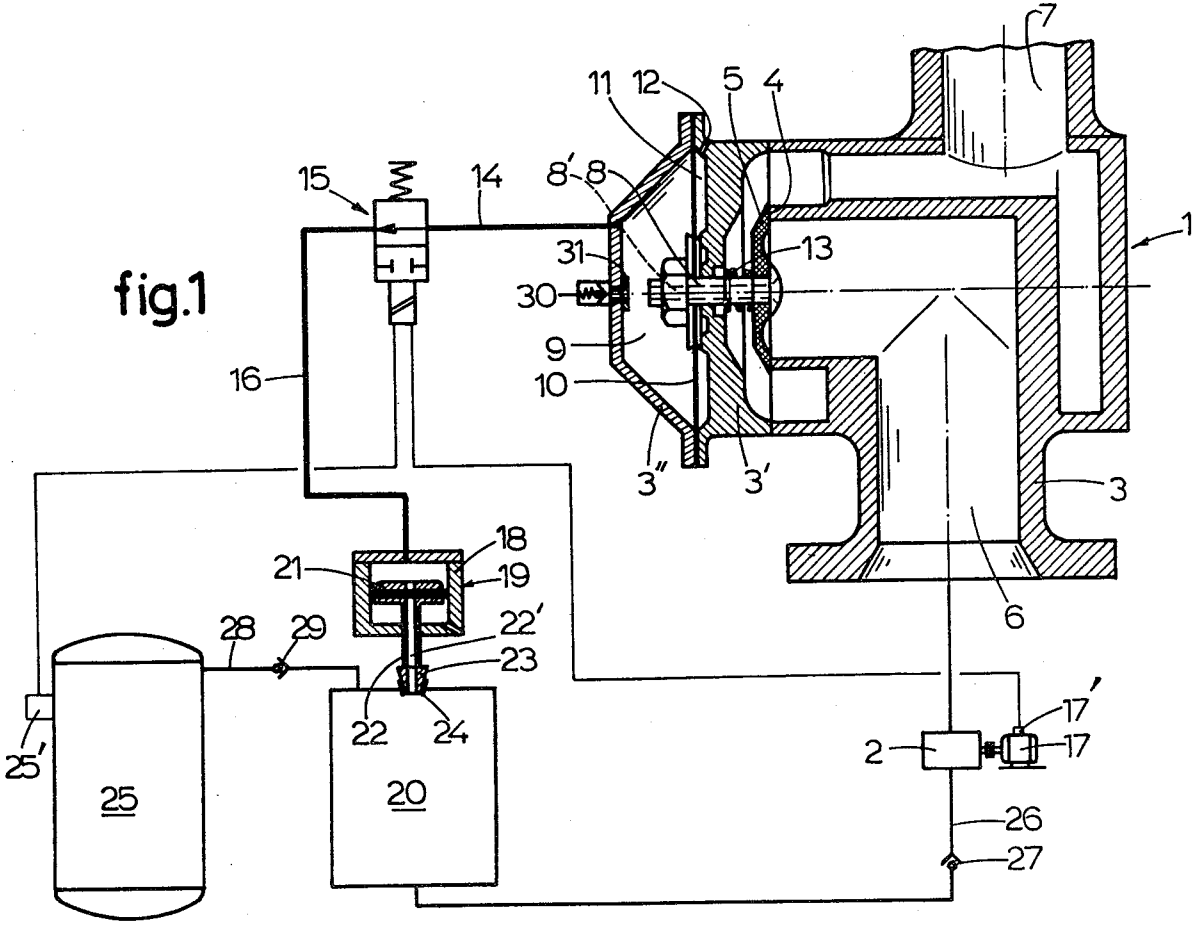
FIG. 1 is a sectional view of a suction control valve with accessory equipment, which is connected to the suction side of a compressor and which is shown during the starting period of the compressor.

In this position of the suction control valve 1 with its accessory equipment as shown in FIG. 1 the compressor can thus be started without a back pressure being built up in the auxiliary pressure vessel 20.

Upon completion of the starting phase of the compressor 2, when the starting switch 17' of the compressor motor 17 is changed over from the star connection to the delta connection, the electromagnetic valve 15 will be actuated, causing this valve 15 to be brought from the open position into the closed position (FIG. 2) and the connection between the conduits 14 and 16 to be interrupted. This will generate a vacuum inside the diaphragm chamber 9, through the bore 8' in the valve stem 8, which vacuum is almost equal to the vacuum prevailing in the space 6 of the valve housing. Since the surface of the diaphragm 10, which is subjected to this vacuum, is considerably larger than the surface of the valve body 5, which is subjected to the vacuum in the space 6 of the valve housing, the diaphragm 10 will be caused to be moved, at the same time carrying along the valve stem 8, so that the valve body 5 is moved to the open position. Consequently the space 6 of the valve housing is brought into open communication with the atmosphere through the space 7 of the valve housing, enabling the compressor 2 to start its compressing action. On account of the passage of air through the space 6 of the valve housing a minor subatmospheric pressure will prevail in this space 6. This subatmospheric pressure will extend through the bore 8' in the valve stem 8 into the diaphragm chamber 9 and will retain the valve body 5 in the open position.

The rapid blow-off valve 19 is likewise in the closed position, since the overpressure prevailing in the auxiliary pressure vessel 20 through the bore in the valve body 23 and the bore 22' in the piston rod 22 loads the piston 21 in the closing direction of the valve body 23, and since the piston surface subjected to the overpressure is considerably larger than the surface of the valve body 23 which is subjected to the overpressure.

As a result of the valve 15 being closed, an overpressure will likewise prevail in the conduit 16.

Figure 3:
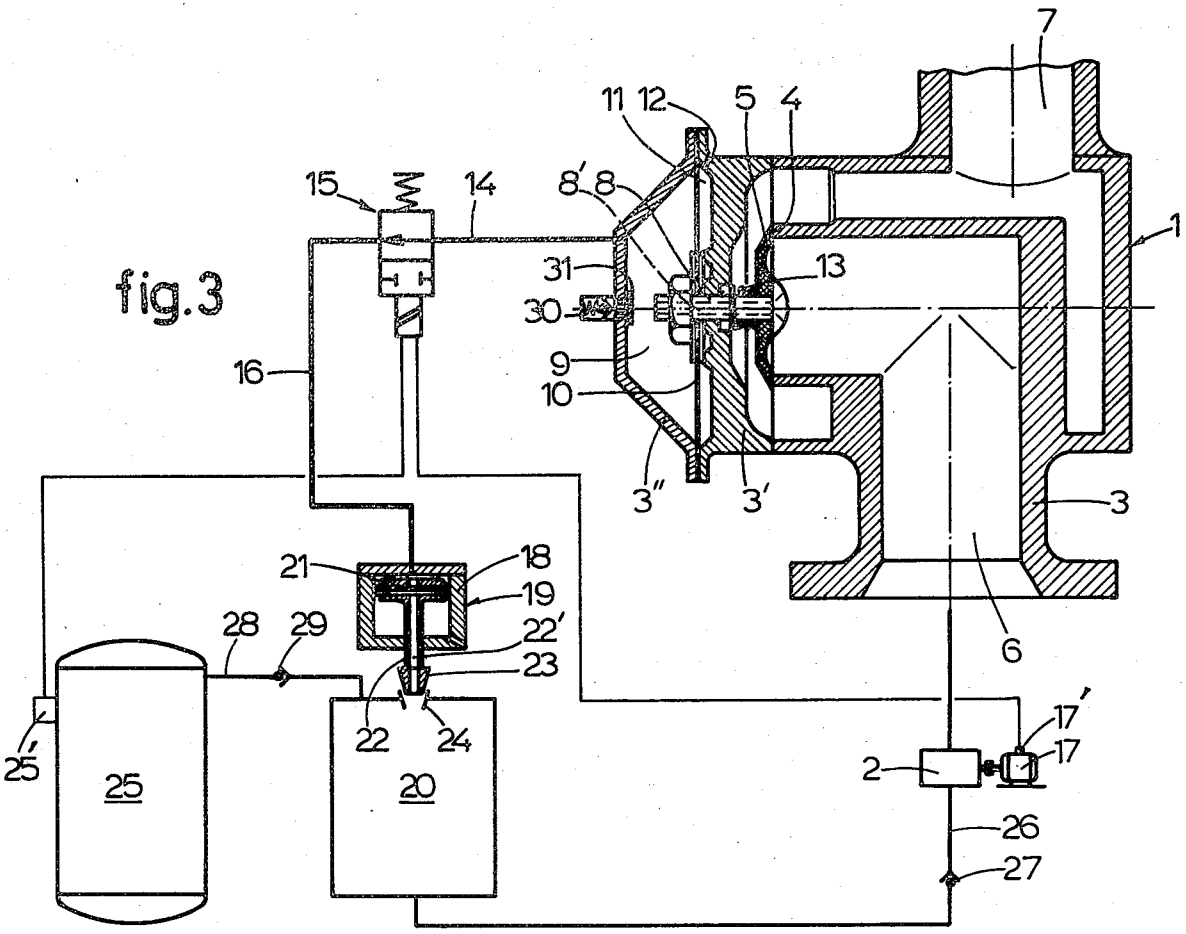
FIG. 3 is a sectional view corresponding with that of FIG. 1, but in which the suction control valve with accessory equipment is in the position assumed during the no-load operation of the compressor.

After the desired final pressure has been reached in the main pressure vessel 25, the electromagnetically operated valve 15 will be de-energized again under the action of a pressure switch 25' in this main pressure vessel 25, causing this valve 15 to be returned to the open position, in which it connects the conduits 14 and 16 to each other. The conduit 16 and the space in the cylinder 18 above the piston 21 are now brought into open communication with the diaphragm chamber 9, thus producing in this chamber an increase of pressure which exerts a force of such magnitude to the diaphragm 10, that the valve body 5 is moved to its closed position. The rapidly diminishing overpressure above the piston 21, which cannot be immediately compensated as a result of the relatively narrow passage of the bore 22' in the piston rod 22, causes the force acting upon the valve body 23 in the opening direction thereof to become greater than the force exerted to the piston 21 in the closing direction, so that the valve body 23 is lifted very rapidly from the seat 24 (FIG. 3). As a result, the delivery side of the compressor 2 is brought, through this seat 24, into open communication with the atmosphere, so that the compressor 2 may run at no load until the compressor motor 17 is switched off.

In order to prevent the possibility of an excessively high pressure occurring in the diaphragm chamber 9, this diaphragm chamber 9 is equipped with a spring-loaded safety valve 30.

Since the valve body 5 tends to rattle under the action of a pulsating inflow of air, the wall of the diaphragm chamber 9 is equipped with a permanent magnet 31, which can retain the valve stem 8 in its position for as long as the valve body 5 is opened.

The invention is not restricted to the embodiment shown in the drawing by way of example, which can be varied in various manners within the scope of the appended claims.

What I claim is:

1. A suction control valve adapted to be connected to the suction side of a compressor and comprising a valve housing, in which a valve seat is formed, which co-operates with a valve body which, in its opened position, brings the suction side of the compressor into open communication with the atmosphere, said valve body being attached to a valve stem which, in its longitudinal direction, is slidably guided in the valve housing for the displacement of the valve body from the closed position to the open position, and vice versa, while a continuous bore in the valve stem is at one end in open communication with the suction side of the compressor, and opens at the other end into a diaphragm chamber, which is located on the side of a diaphragm facing away from the valve body, which diaphragm is fixed to the valve stem, while the diaphragm chamber is connected to a conduit, which accommodates a stop valve.

2. A suction control valve according to claim 1, wherein said stop valve is operated electromagnetically and is controlled by a star-delta switch of the compressor motor.

3. A suction control valve according to claim 1, wherein said stop valve is connected by an additional conduit to a rapid blow-off valve for a pressure vessel connected to the delivery side of the compressor.

4. A suction control valve according to claim 3, wherein the rapid blow-off valve consists of a cylinder which slidingly accommodates a piston, which is fastened upon a hollow piston rod, which bears outside the cylinder a hollow valve body, the bore of which connects to that of the piston rod, said valve body cooperating with a valve seat in the pressure vessel, while the further conduit opens into the cylinder on the side of the piston which faces away from the valve body.

5. A suction control valve according to claim 4, wherein said stop valve is adapted to be operated by a pressure switch which is controlled by the pressure in the pressure vessel.

6. A suction control valve according to claim 5, wherein a magnet is mounted in the diaphragm chamber and co-operates with the valve stem for retaining the valve body in the open position.

7. A suction control valve according to claim 6, wherein a blow-off safety valve is fitted to the diaphragm chamber.

* * * * *